US007815414B2

(12) United States Patent
Devore et al.

(10) Patent No.: US 7,815,414 B2
(45) Date of Patent: Oct. 19, 2010

(54) AIRFOIL MINI-CORE PLUGGING DEVICES

(75) Inventors: Matthew A. Devore, Manchester, CT (US); Francisco J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 716 days.

(21) Appl. No.: 11/881,585

(22) Filed: Jul. 27, 2007

(65) Prior Publication Data

US 2009/0028703 A1 Jan. 29, 2009

(51) Int. Cl.
*F01D 5/18* (2006.01)

(52) U.S. Cl. ..... 415/115; 416/97 R

(58) Field of Classification Search ..... 415/115, 415/1; 416/97 R, 92, 1; 29/889.2
See application file for complete search history.

(56) References Cited

U.S. PATENT DOCUMENTS 4,820,123 A * 4/1989 Hall ..... 416/97 R
7,052,233 B2 * 5/2006 Fried et al. ..... 415/121.2
7,128,530 B2 * 10/2006 McFeat et al. ..... 416/2
7,695,243 B2 * 4/2010 Lee et al. ..... 415/121.1

* cited by examiner

*Primary Examiner*—Ninh H Nguyen
(74) *Attorney, Agent, or Firm*—Bachman & LaPointe, P.C.

(57) ABSTRACT

A turbine engine component, such as a high pressure turbine vane, has an airfoil portion and at least one coolant system embedded within the airfoil portion. Each coolant system has an exit through which a cooling fluid flows, which exit has at least one device for preventing deposits from interfering with the flow of cooling fluid from the exit. The at least one device may be at least one depression and/or at least one grill structure formed from elongated ribs.

30 Claims, 4 Drawing Sheets

AIRFOIL MINI-CORE PLUGGING DEVICES

BACKGROUND

A gas turbine engine component is provided with at least one coolant system embedded within an airfoil portion, which coolant system has at least one exit and means for preventing deposits from interfering with a flow of cooling fluid from the at least one exit.

The design of an advanced high pressure turbine component, such as a high pressure turbine vane, requires that the airfoil portion of the component be cooled with a series of highly convective coolant systems embedded in an airfoil wall. Due to the configuration of the coolant system exits, deposits have a high propensity to accumulate there. As a result, the exit planes have reduced cooling film traces due to exit plugging. When this happens, film cooling of the airfoil wall becomes affected negatively to the point where the local cooling effectiveness is affected adversely. Note that the overall cooling effectiveness is a form of the dimensionless metal temperature ratio for the airfoil. In general, the overall cooling effectiveness of this type of high pressure turbine component is close to 0.7 (unity being the maximum value), and due to film exit deposits, the cooling effectiveness can be lowered to values below 0.2. As a result, the local life capability of the part becomes very limited. Consequences of this limitation result in premature oxidation, erosion and thermal-mechanical fatigue cracking. It is therefore necessary to alleviate this problem.

SUMMARY

In accordance with the instant disclosure, a turbine engine component broadly comprises an airfoil portion having at least one coolant system embedded within the airfoil portion. Each coolant system has at least one exit through which a cooling fluid flows, which at least one exit has means for preventing deposits from interfering with the flow of cooling fluid from the exit.

A method for cooling a turbine engine component is described. The method broadly comprises the steps of forming a turbine engine component having an airfoil portion and at least one coolant system having an exit embedded within the airfoil portion and providing means for preventing deposits from interfering with a flow of cooling fluid from the exit. The method further comprises flowing the cooling fluid through the at least one coolant system and out the exit.

Other details of the airfoil mini-core anti-plugging devices, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
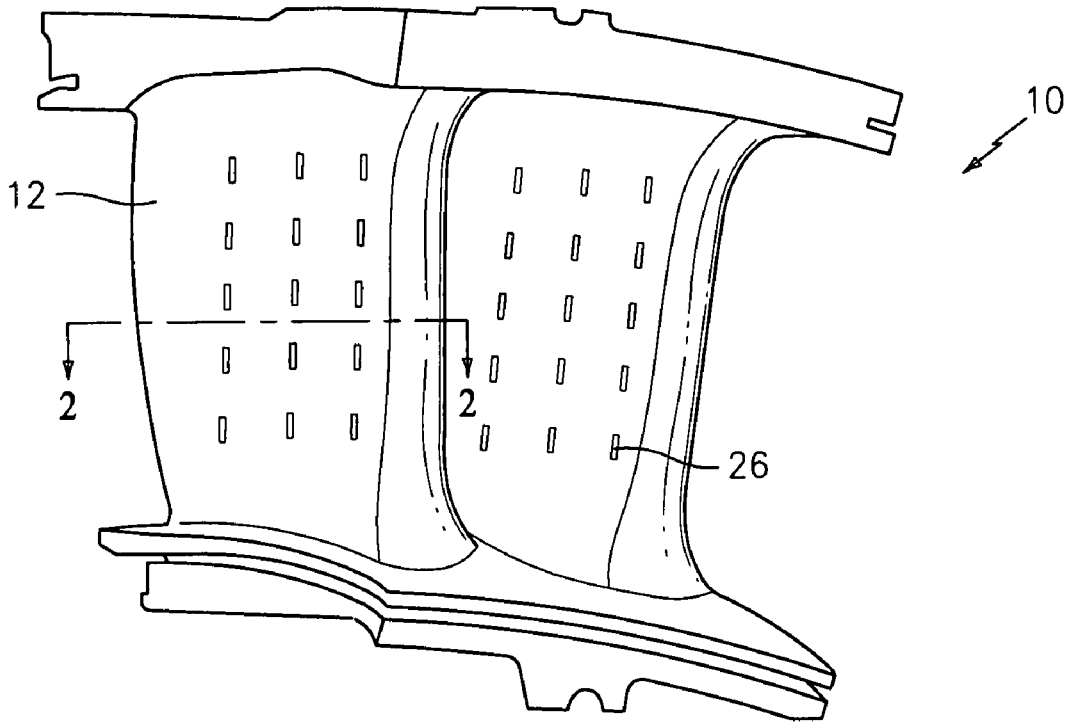
FIG. 1 is a schematic representation of a turbine engine component.
Figure 2:
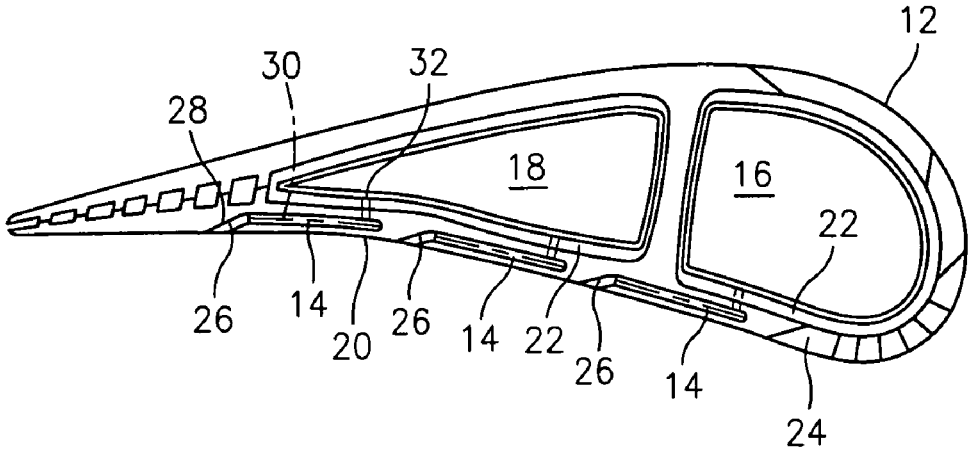
FIG. 2 is a sectional view taken along lines 2-2 in FIG. 1 illustrating mini-core coolant systems embedded within the airfoil portion of the turbine engine component.

FIG. 1 illustrates a pair of turbine engine components 10. Each turbine engine component 10 has an airfoil portion 12 with a plurality of mini-core coolant systems 14 (see FIG. 2), each having an exit 26. As can be seen from FIG. 2, each exit 26 is formed by a wall 28 which extends at an angle from a central axis 30 of the coolant system 14. Each coolant system 14 is embedded within a wall 24 of the airfoil portion 12. Each coolant system 14 receives cooling fluid via at least one opening 32 from one of the cooling fluid supply cavities 16 and 18 in the airfoil portion 12. The exterior surface 20 of the wall 24 is the gas path wall since gas flows over the surface and the interior wall 22 is the coolant wall.

Figure 3A:
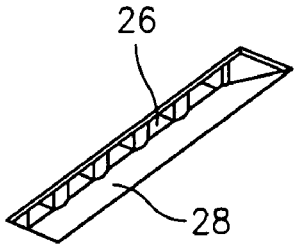
FIGS. 3(*a*)-3(*c*) are schematic representations of the manner in which a coolant system exit becomes plugged.
Figure 3B:
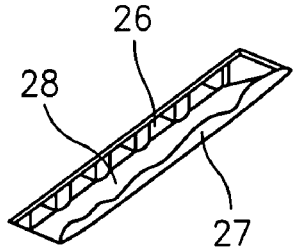
Figure 3C:
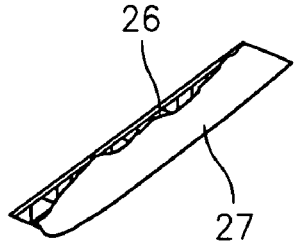
Figure 4A:
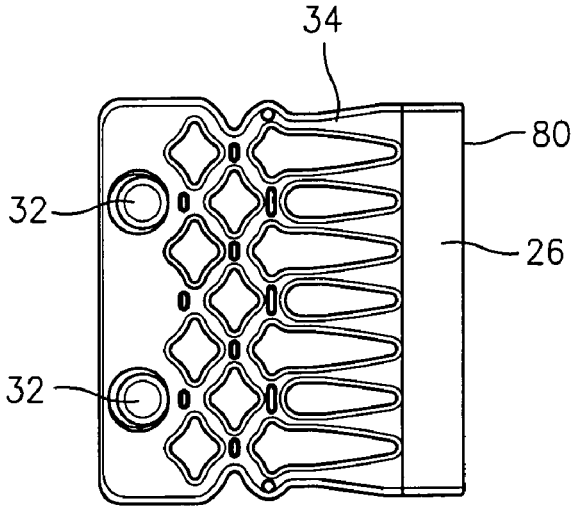
FIGS. 4(*a*) and 4(*b*) are a schematic representation of coolant systems as per design.
Figure 4B:
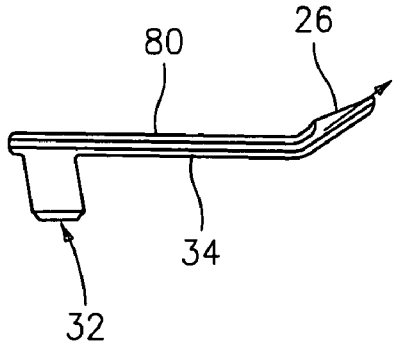

FIGS. 3(*a*)-3(*c*) depict how plugging takes place in an evolutionary manner with deposits 27 laying on the wall 28 sloped at the exits 26 and eventually blocking the exits 26. While FIGS. 3(*a*)-3(*c*) depict the results of deposits in the exits, FIGS. 4(*a*) and 4(*b*) depict views of the mini-core coolant systems 80 as per design intent. Cooling air enters at least one opening 32 and flows through the coolant passageway(s) 34 before exiting at the exit(s) 26 with a high degree of film coverage. This design leads to an advanced way to cool gas turbine high pressure turbine components for very high combustor exit gas temperatures. With exit plugging, the cooling benefits are compromised considerably.

As previously mentioned, it is highly desirable that the exit(s) of the cooling systems embedded in a wall of a turbine engine component 10 be provided with a means for preventing blockage of the exits. To this end, there is described herein a number of means for preventing deposits from interfering with a flow of cooling fluid from the exit(s) of the embedded coolant systems.

Figure 5:
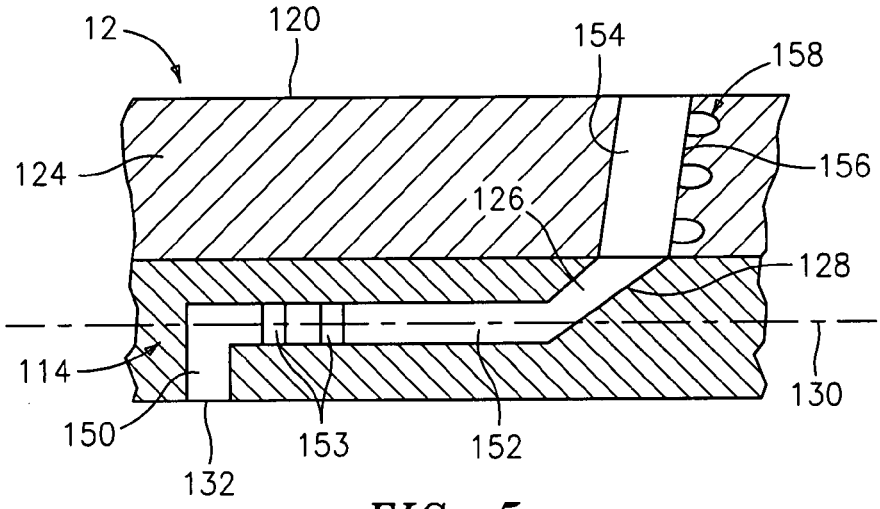
FIG. 5 is a schematic representation of a first embodiment of a coolant system.

Referring now to FIG. 5, there is shown a first embodiment of an improved cooling system in accordance with the present description. As shown therein, a mini-core coolant system 114 is embedded within a wall 124 of the airfoil portion 12 of a turbine engine component, such as a high pressure turbine vane. The coolant system 114 has one or more openings 132 which allow cooling fluid from either cavity 16 or 34 to flow into an inlet passageway 150. The inlet passageway 150 communicates with a central cooling section 152 which may have one or more fluid passageways which communicate with one or more exits 126, typically in the form of slot exits. If desired, the cooling passageways may have the configuration shown in FIG. 4. Further, if desired, the central cooling section 152 may have one or more pedestals or similar devices 153 for increasing the turbulence within the cooling section 152 and thereby increasing the cooling effectiveness.

As can be seen from FIG. 5, the central section 152 has an angled exit 126 with a wall 128 at an angle with respect to a central axis 130 of the central section 152. Between the end of the angled exit 126 and the gas path wall 120, there is a passageway 154 having a wall 156. Formed in the wall 156 are one or more depressions or dimples 158. The depressions or dimples 158 may be formed using any suitable technique known in the art, such as machining, or may be cast structures. Additionally, the depressions or dimples 158 can have any desired shape. For example, the depressions or the dimples 158 can be hemi-spherical in shape. The depressions or dimples 158 provide locations where deposits can accumulate so as not to interfere with a flow of cooling fluid from the exit 126. The depressions or dimples 158 may have any desired depth.

Figure 6:
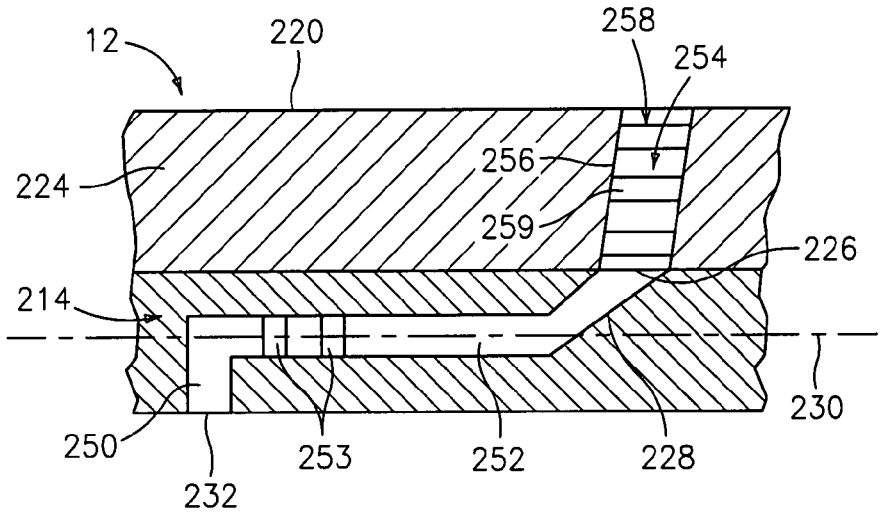
FIG. 6 is a schematic representation of a second embodiment of a coolant system.

Referring now to FIG. 6, there is shown a second embodiment of an improved cooling system in accordance with the present description. In this embodiment, a mini-core coolant system 214 is embedded within a wall 224 of the airfoil portion 12 of a turbine engine component, such as a high pressure turbine vane. The coolant system 214 has one or more openings 232 which allow cooling fluid from either cavity 16 or 34 to flow into an inlet passageway 250. The inlet passageway 250 communicates with a central cooling section 252 which may have one or more fluid passageways which communicate with one or more exits 226, which may be in the form of slot exits. If desired, the cooling passageways may have the configuration shown in FIG. 4. Further, if desired, the central cooling section 252 may have one or more pedestals or similar devices 253 for increasing the turbulence within the cooling section 252 and thereby increasing the cooling effectiveness.

As can be seen from FIG. 6, the central section 252 has an angled exit 226 with a wall 228 at an angle with respect to a central axis 230 of the central section 252. Between the end of the angled exit 226 and the gas path wall 220, there is a passageway 254 having a wall 256. Formed in the wall 256 are one or more grill structures 258 which serve to protect the exit(s) 226 from having deposits penetrating into the exit(s) 226 so that the deposits do not interfere with the flow of cooling fluid from the exit(s) 226. The grill structures 258 are in-line with the flow of the cooling fluid out of the exit(s) 226. The grill structures 258 accelerate the cooling flow through the exit slot(s) or passageway(s) 254, thus minimizing the amount of time for dirt to accumulate or deposit at the slot exit. Each of the grill structures is formed by ribs 259 elongated towards the end of the mini-core slot exits. The grill structures 258 may be formed using any suitable technique known in the art, such as machining, or may be cast structures. The depth of the grill structures 258 should be such that they should start at the same height as that of the inner mini-core and transition into the slot without extending past the external airfoil profile.

Figure 7:
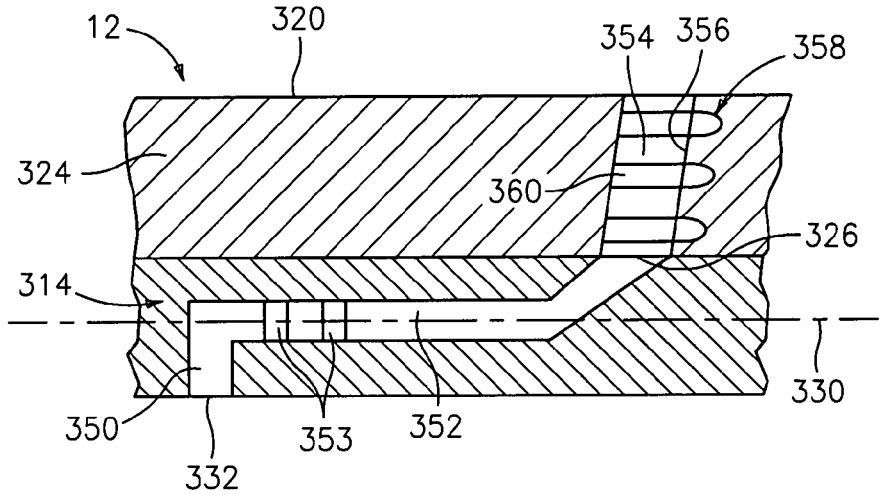
FIG. 7 is a schematic representation of a third embodiment of a coolant system.

Referring now to FIG. 7, there is shown a third embodiment of an improved cooling system as described herein. In this embodiment, mini-core coolant system 314 is embedded within a wall 324 of the airfoil portion 12 of a turbine engine component, such as a high pressure turbine vane. The coolant system 314 has one or more openings 332 which allow cooling fluid from either cavity 16 or 34 to flow into an inlet passageway 350. The inlet passageway 350 communicates with a central cooling section 352 which may have one or more fluid passageways which communicate with one or more exits 326. If desired, the cooling passageways may have the configuration shown in FIG. 4. Further, if desired, the central cooling section 352 may have one or more pedestals or similar devices 353 for increasing the turbulence within the cooling section 352 and thereby increasing the cooling effectiveness.

As can be seen from FIG. 7, the central section 352 has an angled exit 326 with a wall 328 at an angle with respect to a central axis 330 of the central section 352. Between the end of the angled exit 326 and the gas path wall 320, there is a passageway 354 having a wall 356. Formed in the wall 356 are one or more depressions or dimples 358. Also formed in the passageway 354 are one or more grill structures 360. As before, the dimples 358 and the grill structures 360 may be formed using any suitable technique known in the art, such as machining, or may be cast structures. The dimples 358 and the grill structures 360 serve to accumulate deposits and protect the exits 326 from having deposits penetrate into the exits 326 so that the deposits do not interfere with the flow of cooling fluid exiting from the exits 326. The dimples 358 and the grill structures 360 may have any desired depth. The dimples 358 may be offset from the grill structures 360.

The dimples, in their various embodiments, are negative features which form pockets in which deposits may accumulate, thus removing them from the flow of cooling fluid coming from the exits of the coolant systems.

Figure 8:
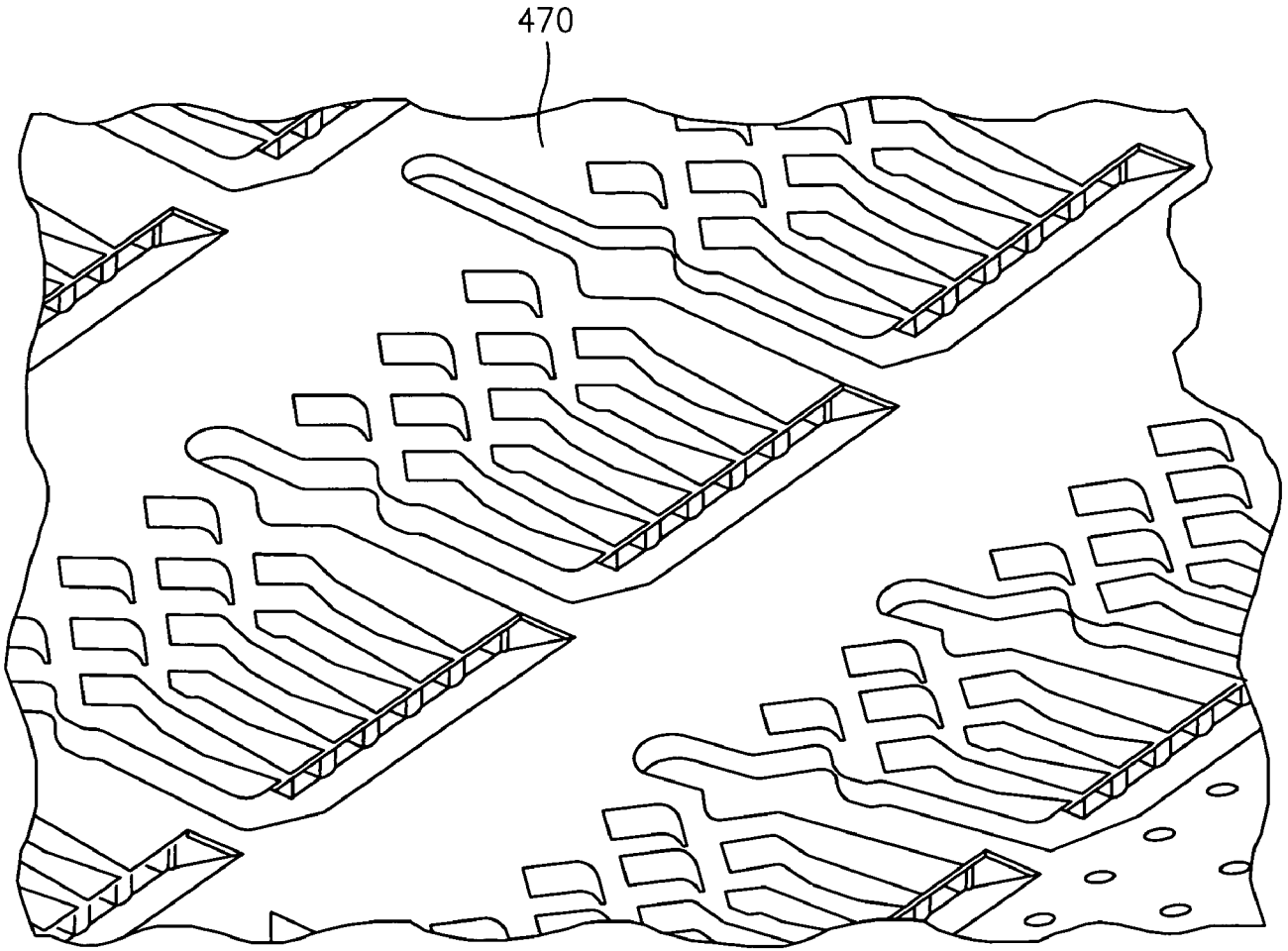
FIG. 8 illustrates a plurality of refractory metal core which can be used to form the coolant systems embedded within the wall of the airfoil portion of the turbine engine component.

A turbine engine component with the coolant systems described herein may be formed using any suitable means known in the art. For example, the turbine engine component with the airfoil portion and the cavity portions 14 and 16 may be formed using any suitable casting technique known in the art. The embedded coolant system may be formed using refractory metal core technology such as the refractory metal cores 470 shown in FIG. 8. The depressions and/or grill structures may be formed using any suitable technique known in the art, such as machining the exit passageway after casting of the turbine engine component has been completed. Alternatively, the depressions and/or grill structures may be formed as cast structures using any suitable casting technique known in the art.

The coolant systems described herein have the advantage that they keep the mini-core coolant system exit slots from plugging, resulting in high local cooling effectiveness from the benefits of internal convection followed by larger mini-core exit film cooling coverage.

It is apparent that there has been provided in accordance with the present description an airfoil mini-core anti-plugging devices which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations which are embraced by the following claims.

What is claimed is:

1. A turbine engine component comprising:

an airfoil portion;

at least one coolant system embedded within said airfoil portion;

each said coolant system having an exit through which a cooling fluid flows; and said exit having means for preventing deposits from interfering with a flow of cooling fluid from said exit.

2. The turbine engine component of claim 1, wherein said deposit preventing means comprises at least one negative depression adjacent said exit for accumulating deposits.

3. The turbine engine component of claim 1, wherein said deposit preventing means comprises a plurality of negative depressions adjacent said exit for accumulating deposits.

4. The turbine engine component of claim 1, wherein said deposit preventing means comprises a grill structure having at least one elongated rib adjacent an end of said exit for preventing deposits from entering said exit.

5. The turbine engine component of claim 1, wherein said deposit preventing means comprises a grill structure having a plurality of elongated ribs adjacent an end of said exit for preventing deposits from entering said exit.

6. The turbine engine component of claim 1, wherein said deposit preventing means comprises a grill structure having at least one rib adjacent an end of said exit and at least one dimple adjacent an end of said exit.

7. The turbine engine component of claim 6, wherein said at least one rib is offset from said at least one dimple.

8. The turbine engine component of claim 1, wherein said deposit preventing means comprises a grill structure comprising a plurality of ribs adjacent an end of said exit and a plurality of depressions.

9. The turbine engine component of claim 8, wherein each of said ribs forming said grill structure has a longitudinal dimension in a direction of flow of said cooling fluid.

10. The turbine engine component of claim 1, wherein said exit has an angled wall portion and said deposit preventing means is located within said wall portion.

11. The turbine engine component of claim 1, wherein said exit has an angled ramp portion and said deposit preventing means is located adjacent said ramp portion.

12. The turbine engine component of claim 1, wherein each said coolant system has a plurality of means for increasing turbulence within said coolant system.

13. The turbine engine component of claim 12, where said turbulence increasing means comprises a plurality of pedestals positioned within a coolant passageway.

14. The turbine engine component of claim 1, wherein each said coolant system has a plurality of flow channels terminating in a plurality of slot exits.

15. The turbine engine component of claim 1, wherein each said coolant system has means for introducing a cooling fluid into said coolant system.

16. The turbine engine component of claim 15, wherein said introducing means comprises at least one opening through which cooling fluid enters said coolant system.

17. The turbine engine component of claim 16, wherein said introducing means comprises a plurality of openings.

18. A method for cooling a turbine engine component comprising the steps of:

forming a turbine engine component having an airfoil portion and at least one coolant system embedded within the airfoil portion and having at least one exit;

providing means for preventing deposits from interfering with a flow of cooling fluid from each said exit; and flowing said cooling fluid through said at least one coolant system and out each said exit.

19. The method of claim 18, wherein said deposit preventing means providing step comprises forming at least one depression adjacent each said exit having a depth sufficient to accumulate deposits.

20. The method according to claim 19, wherein said at least one depression forming step comprises forming a plurality of depressions.

21. The method of claim 18, wherein said deposit preventing means providing step comprises forming at least one grill structure adjacent each said exit for preventing deposits from penetrating each said exit.

22. The method of claim 21, wherein said at least one grill structure forming step comprises forming a plurality of ribs which are elongated in a direction of flow of said cooling fluid.

23. The method of claim 18, wherein said deposit preventing means providing step comprises forming at least one depression and at least one grill structure adjacent each said exit.

24. A method for manufacturing a turbine engine component comprising the steps of:

forming a turbine engine component having an airfoil portion and at least one coolant system embedded within the airfoil portion;

forming at least one exit for said at least one coolant system; and forming means for preventing deposits from interfering with operation of said at least one exit.

25. The method according to claim 24, wherein said deposit preventing means forming step comprises forming at least one depression adjacent each said exit having a depth sufficient to accumulate deposits.

26. The method according to claim 25, wherein said at least one depression forming step comprises forming a plurality of depressions.

27. The method according to claim 24, wherein said deposit preventing means forming step comprises forming at least one grill structure adjacent each said exit for preventing deposits from penetrating said exit.

28. The method according to claim 27, wherein said at least one grill forming step comprises a plurality of ribs which are elongated in a direction of flow of said cooling fluid.

29. The method according to claim 27, further comprising forming at least one depression adjacent each said exit.

30. The method according to claim 27, further comprising forming a plurality of depressions adjacent each said exit.

* * * * *